United States Patent [19]

Highberg et al.

[11] 4,018,206

[45] Apr. 19, 1977

[54] MACHINE FOR DRESSING FIXED-SUPER-ABRASIVE TOOLS

[75] Inventors: Carle W. Highberg, Rolling Meadows; John Dolido, Northbrook, both of Ill.

[73] Assignee: Engelhard Minerals & Chemicals Corporation, Murray Hill, N.J.

[22] Filed: Aug. 11, 1975

[21] Appl. No.: 603,669

[52] U.S. Cl. ..... 125/11 CD; 51/33 R

[51] Int. Cl.[2] ..... B24B 53/04

[58] Field of Search ..... 51/33 R, 33 W; 125/11 CD

[56] References Cited

UNITED STATES PATENTS

| | | | |
|---|---|---|---|
| 2,373,882 | 4/1945 | Eglinton | 51/33 W UX |
| 2,633,675 | 4/1953 | Ellis | 51/33 R |
| 2,634,557 | 4/1953 | Seidner | 51/33 W |
| 2,965,162 | 12/1960 | Hawkinson | 51/33 W X |

*Primary Examiner*—Harold D. Whitehead

[57] ABSTRACT

This machine is designed for dressing fixed-super-abrasive tools employed in the grinding and polishing of optical and ophthalmic lenses having a toric surface configuration. It comprises a base with an upstanding frame having an arm pivotally supported thereon for at least limited vertical arc-like oscillatory movement about the horizontal axis. A workpiece holder assembly suitable for holding the fixed-super-abrasive tool is releasably securable to the arm and movable along the arm to any predetermined position relative to the horizontal axis whereby the workpiece in the workpiece holder assembly is vertically oscillated at a preselected radius. The base also includes a grinder support bed both horizontally movable with respect thereto and controllably rotatable about a vertical axis through at least a limited horizontal arc. A powered, fast wearing, conventional abrasive grinding wheel rotatable about a vertical axis is upstandingly supported on the grinder support bed and disposed to traverse adjacent the workpiece holder assembly in an arc-like movement as the grinder support bed controllably oscillates, whereby the toric surface of the vertically-oscillating workpiece is dressed by the horizontally-oscillating grinding wheel.

6 Claims, 6 Drawing Figures

FIG.3
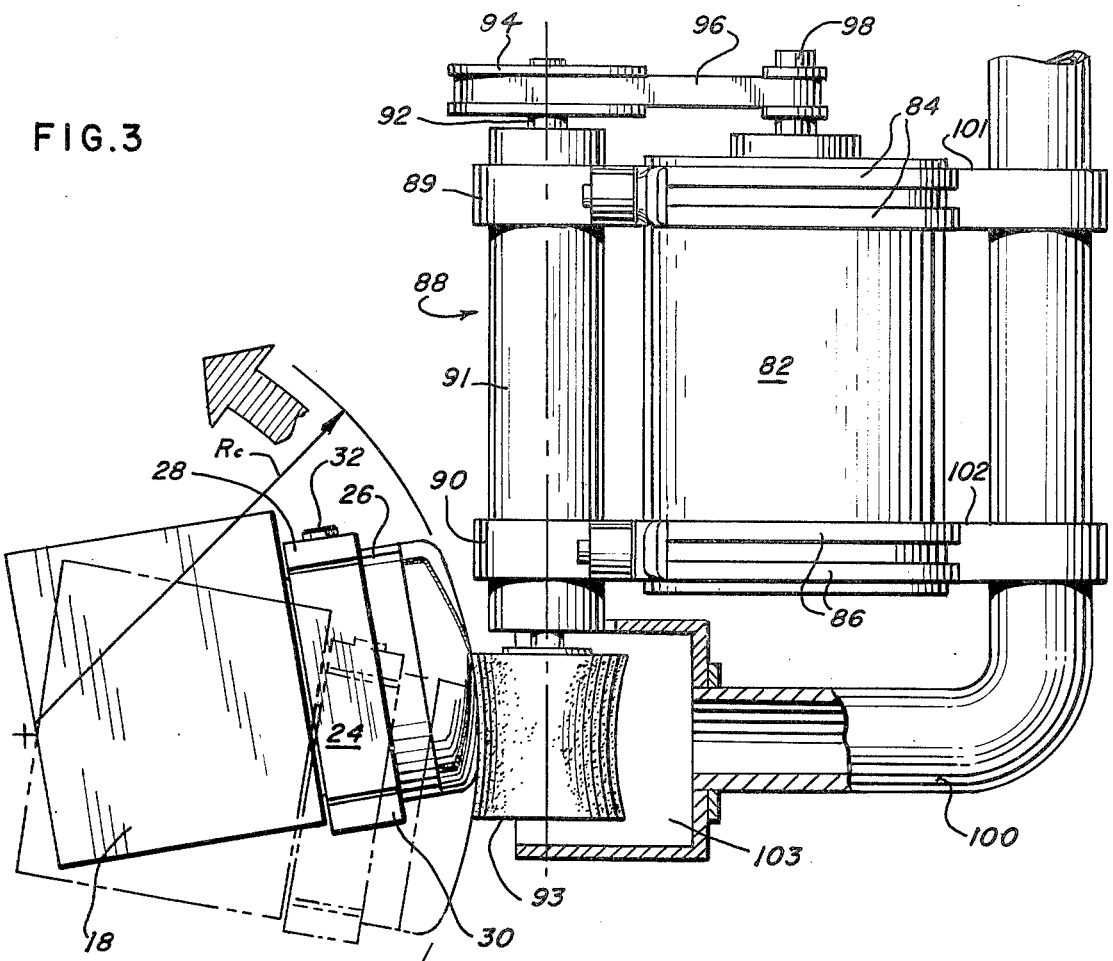
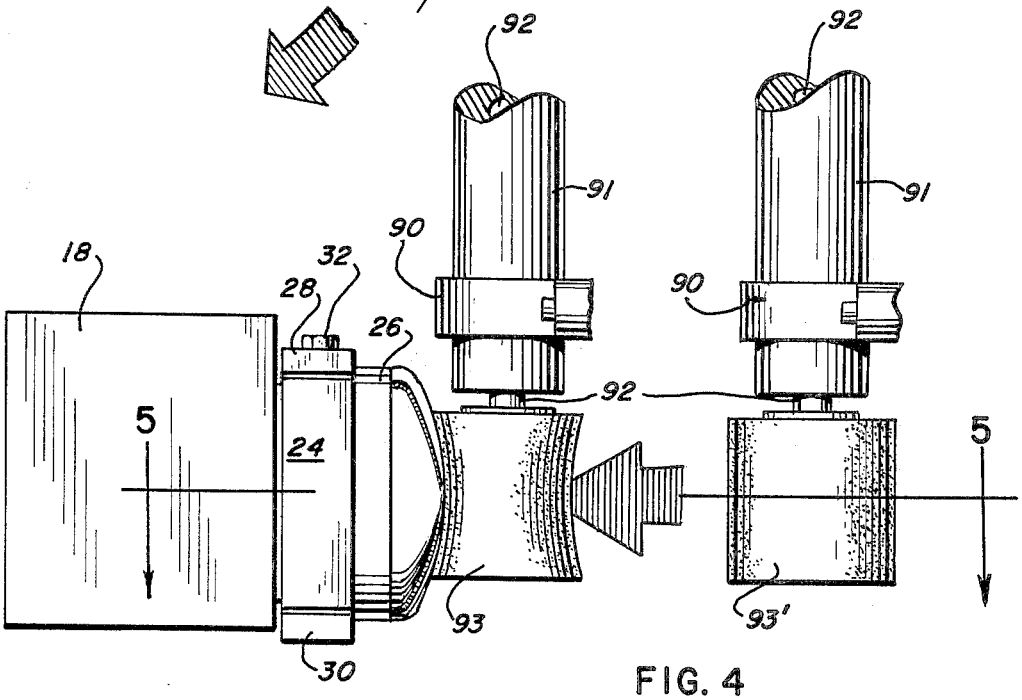
FIG. 4

MACHINE FOR DRESSING FIXED-SUPER-ABRASIVE TOOLS

BACKGROUND OF THE INVENTION

1. Field of the Invention

This invention relates to a machine for dressing tools used in the grinding and polishing of optical and ophthalmic lenses having a toric surface configuration. More particularly, it relates to a novel machine for generating or restoring the accurate toric form of fixed-super-abrasive tools employed in the production of toric lenses, such as is described in the copending patent application of Carle W. Highberg, U.S. Pat. Ser. No. 569,303, filed Apr. 17, 1975.

While the present invention is described herein with reference to a particular embodiment, it should be understood that the invention is not limited thereto. The elements of the present invention may be employed in a variety of structural forms, as those skilled in the art will recognize in the light of the present disclosure.

As used herein, the term "super-abrasive" refers to abrasive media suitable for grinding and polishing conventional ophthalmic and optical lens glass and having a hardness on the Knoop scale in excess of about 3,000 kg/mm$^2$, preferably substantially in excess thereof. A comparison of Knoop and Mohs hardness values for conversion purposes is available in standard handbooks. Commercially known super-abrasives include natural and synthetic industrial diamonds and cubic boron nitride. These contrast with "conventional abrasives" of limited hardness, i.e., a hardness less than about 3,000 kg/mm$^2$. Commercially available conventional abrasives include, for example, garnet, silicon carbide, emery, alumina, zirconium oxide, cerium oxide, or the like.

The term "fixed", as used herein in connection with either super-abrasives or conventional abrasives, refers to the disposition of the abrasive particles in the form of a solid or bonded tool in contrast to being disposed in a liquid slurry or similar fluid medium. As will be apparent from the description herein, the machine of the present invention is specifically designed to use a fast-wearing fixed conventional abrasive in the form of a grinding wheel for dressing the toric surface of a fixed-super-abrasive tool.

2. Description of the Prior Art

In the aforementioned copending U.S. Pat. application Ser. No. 569,303, a novel fixed-super-abrasive tool for the grinding of optical and ophthalmic lenses and the like, particularly toric-configured lenses, and the method of making the same have been described in detail. In brief, it comprises a rigid backing member having a malleable wafer releasably secured thereto, the malleable wafer comprising super-abrasive particles, e.g., diamonds, in a powdered metal matrix, e.g., a powdered tin-copper alloy matrix.

Upon the initial manufacture thereof, or after substantial use resulting in detectable wear, the working surfaces of these fixed-super-abrasive tools may require a dressing operation to generate or restore the toric curvature within the required precise tolerances. The dressing of these toric-configured, fixed-super-abrasive tools presents unique problems for which prior-art dressing or shaping machines have not been designed and which are not capable of coping therewith.

There are, for example, conventional lap cutters and shaping machines for generating toric curvatures on conventional grinding and polishing tools, such as cast iron grinding tools used in connection with liquid slurries containing conventional abrasives. Such toric shaping machines are available commercially from suppliers of optical processing equipment, e.e., Shuron-Continental Division of Textron, Inc., Coburn Optical Industries, Inc., and others.

In these conventional shapers, the cutter, e.g., a single point tungsten caribide tip, oscillates in a vertical plane at a first predetermined radius, the motion being essentially a vertical arc. Simultaneously, the workpiece, e.g., the cast iron tool on which the toric surface is being generated, is moved across the path of the vertically-oscillating cutter in a horizontal plane at a second predetermined radius, the motion being essentially a horizontal arc at a second predetermined radius. The combined dressing action about two axes at right angles to each other generates the desired toric surface on the workpiece.

Manifestly, it is critically important that the radii at which the combined dressing action occurs remain constant. In a conventional shaping operation, the locus of the cutting action is set by the position of the tip of the tungsten carbide tool. This presents no problem when shaping a conventional cast iron workpiece because the tungsten carbide shaping tip is so hard relative to the cast iron workpiece and therefore no significant wear of the tip occurs. Thus no significant change in the radii occurs.

When the workpiece contains fixed-super-abrasives, however, the much greater hardness of the workpiece wears away the cutter at a fast rate. This reduces the radii at which the cutting action occurs. This in turn changes the curvature in both directions and results in undesired and unacceptable distortion of the toric surface being dressed.

Even if the tungsten carbide tip were replaced with a single point fixed-super-abrasive tool, the tip itself would still wear away at a rate comparable to that of the super-abrasive tool being dressed. This would also be unacceptable. Moreover, for most purposes, the single point super-abrasive tip would be worn away at a much faster rate because the contacting area of the single point tip would be a much smaller area than the surface area being dressed, thus concentrating all of the wear in a small area.

OBJECTS OF THE INVENTION

It is therefore a general object of the present invention to provide a dressing machine which copes with the aforementioned problems. It is another general object to provide a machine of novel construction and design for dressing toric-configured, fixed-super-abrasive tools. It is another general object to provide a low cost means for dressing toric-configured, fixed-super-abrasive tools which can be "grafted" onto conventional shaping machinery as a removable attachment, thereby reducing capital investment and converting the conventional shaping machine to multipurpose operation.

It is a specific object to provide a low-cost, highly efficient machine for dressing fixed-super-abrasive tools having a toric configuration, wherein substantial wear of the dressing tool will not significantly distort the radii of curvature of the toric surface. It is another specific object to provide a machine for dressing fixed-super-abrasive tools wherein the dressing tool itself need not have any initial predetermined configuration or curvature.

It is another specific object to provide a machine for dressing fixed-super-abrasive tools which takes advantage of the relatively high rate of wear of the dressing abrasive. It is a further object to provide a dressing machine for generating or restoring the toric configuration to fixed-super-abrasives which employs a low cost, fixed conventional abrasive as the cutting medium.

These and other objects of the present invention will become apparent as the detailed description proceeds.

SUMMARY OF THE INVENTION

These objects are achieved in a particularly advantageous embodiment by a relatively simple and novel modification or conversion of conventional lap cutters or shaping machines so that they can cope with the unique problems associated with the dressing of toric-configured, fixed-super-abrasive tools. In this conversion embodiment, the present invention features a reversal of the position of the cutter (dressing tool) and the workpiece. In addition, instead of using a single point cutting tip which is harder than the surface being cut or dressed, the dressing action is achieved by means of a fast wearing conventional abrasive grinding wheel, e.g., an aluminum oxide or silicon carbide wheel having a mesh size in the 20–400 range (U.S. Sieve Series).

In the converted configuration of the present invention, the workpiece (fixed-super-abrasive tool) oscillates vertically at the first predetermined radius and the revolving grinding wheel oscillates horizontally, the grinding surface thereof being at the second predetermined radius. The combined action imparts the desired base curve and cross curve of the toric surface. As will become apparent, the much faster rate of wear of the conventional abrasive, as compared with that of the super-abrasive being dressed, is an advantageous feature of the present invention.

Since there is no substantial wear of the fixed-super-abrasive tool as it is being dressed, the radii of the grinding action in each direction remain constant. This contrasts with the conventional shapers wherein, as aforementioned, the tungsten carbide cutter would wear rapidly if used to dress fixed-super-abrasives. Putting it another way, in the conventional shapers the radii of the base and cross curves are maintained by the relative hardness of the cutting tool. In the novel dressing machine of the present invention, the radii of the base and cross curves are maintained by the relative hardness of the fixed-super-abrasive workpiece itself.

More generally, the dressing machine of the present invention comprises a base with an upstanding frame having an arm pivotally supported thereon for at least a limited vertical arc-like oscillatory movement about a horizontal axis. Conventional means may be provided for imparting a desired oscillatory movement to the arm. A workpiece holder assembly suitable for holding the fixed-super-abrasive workpiece to be dressed is releasably secured to said arm and movable therealong to any predetermined position relative to the horizontal axis whereby the workpiece in the workpiece holder assembly is readily oscillated at a predetermined radius corresponding to the desired cross curve of the toric surface.

A grinder support bed is secured to, or may be an integral part of, the base and is both horizontally movably with respect thereto as well as being controllably oscillatable about a vertical axis through at least a limited horizontal arc. A grinding wheel rotatable about a vertical axis is upstandingly supported on the grinder support bed and disposed to traverse adjacent the workpiece holder assembly in an arc-like movement as the grinder support bed controllably oscillates. The radius of the arc-like movement of the rotating grinding wheel is selected so that the grinding action occurs along a horizontal curvature corresponding to the base curve of the toric surface. The means for rotating the grinding wheel preferably comprises an electric motor operably connected to the grinding wheel by a belt or equivalent drive. Alternatives include pneumatic or hydraulic motors or the like, as well as direct drive alternatives.

Because the dressing action is provided by a relatively fast wearing grinding wheel, means for disposing of the residue must be provided. In a preferred embodiment, the means comprise suction means such as a vacuum cleaner system, the inlet to which is immediately adjacent the grindling wheel. This system may be supplemented by deflectors, baffles, shields or the like adjacent the grinding wheel to enhance residue recovery and protect nearby personnel.

In the above brief description and the following detailed description and claims, it should be understood that the terminology "horizontal" and "vertical" should be considered and interpreted as relative terms. The machine obviously can be designed so that the vertical motion could be converted to a horizontal motion, and vice versa. Moreover, the motions need not necessarily be in vertical or horizontal planes but, rather, can be in tilted planes so long as the right-angle relationship of the motions is retained so as to dress the toric configuration.

BRIEF DESCRIPTION OF THE DRAWINGS

The present invention will be more clearly understood from the following detailed description of a specific embodiment read in conjunction with the accompanying drawings wherein:

FIG. 3 is an elevation view on a magnified scale of the electric-belt-driven grinding wheel of the embodiment shown in FIGS. 1 and 2, the motion of the workpiece and holder being indicated by large arrowheads and the radius of curvature corresponding to the cross curve being indicated by the single arrow and arc symbol;

FIG. 4 shows fragmentary views of the grinding wheel of FIG. 3 both before the dressing operation is commenced and during the dressing opeation, the two views illustrating the relatively high rate of wear of the fixed conventional abrasive of the grinding wheel;

It should be understood that the drawings are not necessarily to scale and that the embodiment is in some respects represented by symbols, diagrammatic representations and fragmentary and cut-away views. In certain instances, mechanical details which are not necessary for an understanding of the present invention or which render other details difficult to perceive have been omitted. It should be understood, of course, that the invention is not necessarily limited to the particular embodiment illustrated herein.

DETAILED DESCRIPTION OF THE DRAWINGS, INCLUDING PREFERRED EMBODIMENT

Figure 1:
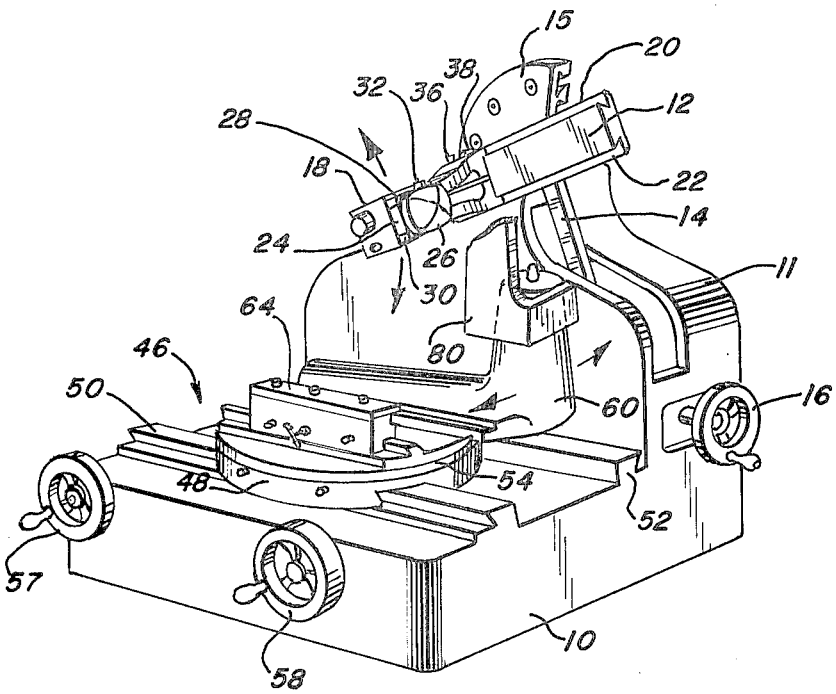
FIG. 1 is a cut-away perspective view of one version of the conversion embodiment of the present invention revealing the position of the fixed-super-abrasive workpiece on the vertically-oscillating arm, the motions of the workpiece and mounting stand for the grinding wheel (not shown) being indicated by the curved arrows.
Figure 2:
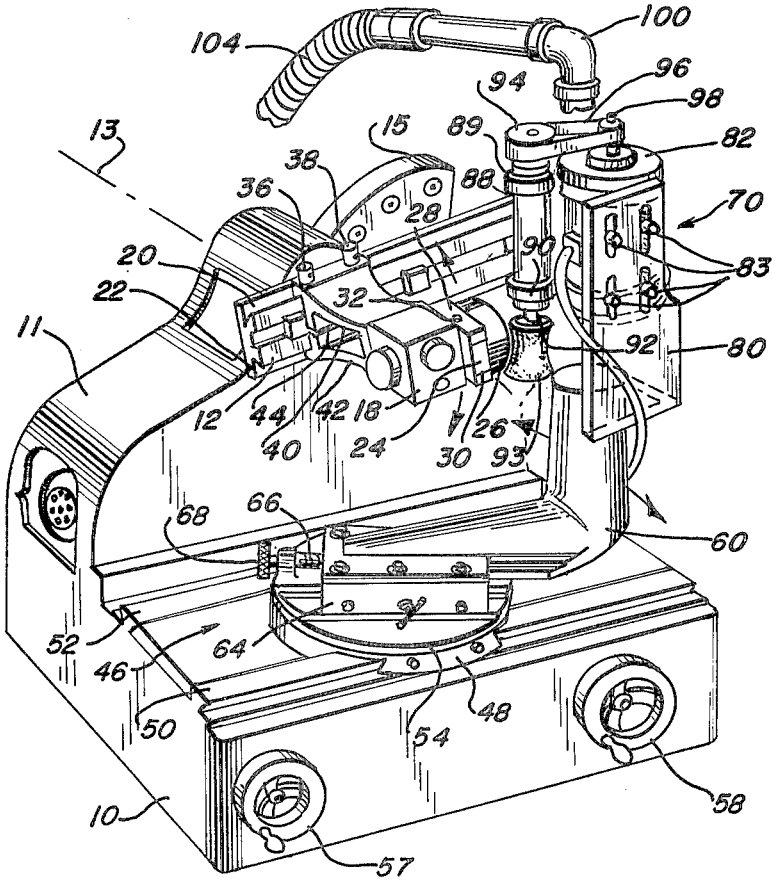
FIG. 2 is another perspective view of the embodiment of FIG. 1 viewed from a different angle, the cut-away portions (e.g., grinding wheel assembly) being restored, the motions of the components again being indicated by curved arrows.

Referring to FIGS. 1 and 2 together, those skilled in the art and knowledgeable as to commercially available shaping machines used in the optical and ophthalmic field, will recognize that the basic structure depicted is a Shuron-Continental 410A high-speed toric shaper sold by the Shuron-Continental Division of Textron, Inc. Since it is well known in the art, only those elements essential to an understanding of the present invention will be described herein.

The machine comprises a base 10 with upstanding frame 11 having a driven arm 12 pivotally supported thereon for at least limited vertical arc-like oscillatory movement about the horizontal axis indicated by extended phantom line 13 in FIG. 2. The rate and arc of rotation of arm 12 is controlled in part by an electric-driven mechanism which is not shown except for the lever arm 14. The coupling of the mechanism to driven arm 12 includes driven guide 15 which is fixedly secured to driven arm 12. Manual operation of the electric-driven mechanism for adjustment purposes or the like can be achieved by means of an engagement mechanism or clutch controlled by normally-disengaged hand wheel 16.

For puposes of the present invention, the conventional tool holder 18, which is slidingly mounted in undercut guide channels 20 and 22 on arm 12, is converted by means of holder 24 for rigidly holding in place the fixed-super-abrasive workpiece 26. As depicted in FIGS. 1–5, workpiece 26 is a diamond-containing tool having a generally oval shape, a toric-configured working surface and X-shaped coolant channels therein. Manifestly, the workpiece may have a variety of shapes, including circular, rectangular, or the like. It is the toric-configured working surface which is dressed on the present machine. Workpiece 26 is held rigidly in holder 24 by means of upper and lower gripping jaws 28 and 30, which may be tightened by bolt means 32.

Tool holder 18 is fixedly secured at any point along arm 12 by tightening threaded locking members 36 and 38, which flex the bifurcated mounting structure or legs 40 and 42 of tool holder 18 together along separation space or split 44, whereby the extremities of the legs securely grip channels 20 and 22 of arm 12. Thus, by proper positioning of the holder assembly along arm 12, the workpiece 26 may be oscillated back and forth in a vertical plane at any predetermined radius, i.e., the radius of curvature corresponding to the desired cross curve on the working surface of workpiece 26, as depicted as Rc in FIG. 3.

Figure 6:
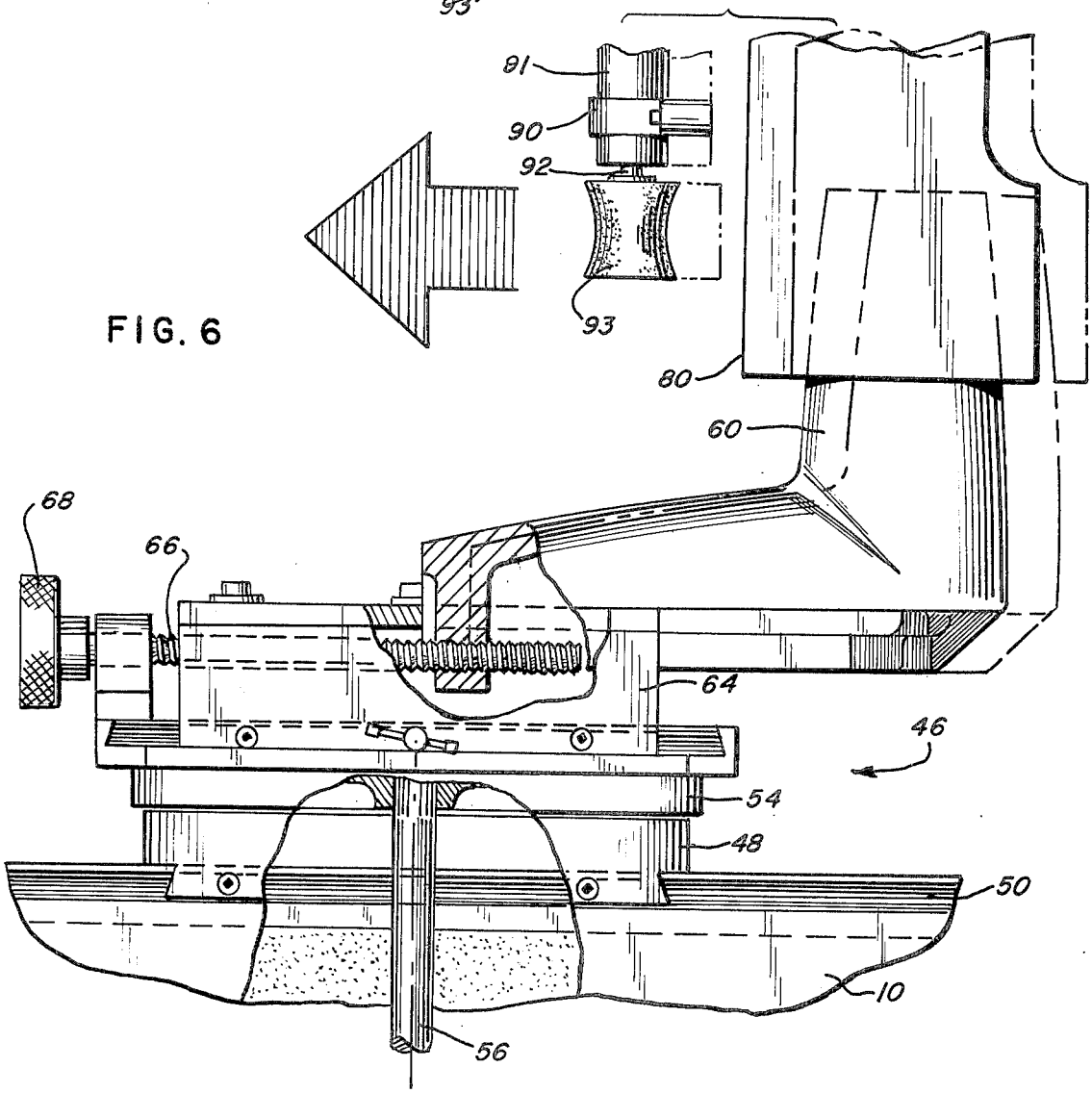
FIG. 6 is a fragmentary cut-away view of the grinder bed and grinding wheel of the embodiment of FIGS. 1 and 2, showing by means of solid and phantom lines the movement thereof in the horizontal plane as the dressing operation continues.

The machine of the present invention also comprises grinder support bed 46 comprising lower plate 48 slidingly mounted on horizontal parallel guides 50 and 52 of base 10 and upper plate 54 pivotally mounted for at least limited oscillatory movement about a vertical axis, as diagrammatically suggested for simplicity by vertical mounting shaft 56 in FIG. 6, the actual mechanism for so doing being more complex and known to those skilled in the art but not representing by itself the novelty in the present invention. The horizontal positioning of support bed 46 along guides 50 and 52 is controlled by hand wheel 57. The rotational positioning of upper plate 54 about axis 56 is controlled by hand wheel 58.

Automatic control mechanisms (not shown) may be used to adjust the movement of the bed. Thus, for example, after each vertical oscillation (half cycle or full cycle) of arm 12, the rotational positioning of plate 54 may be advanced or returned a preselected increment of the full oscillatory arc in a stepwise fashion. As an example, arm 12 may oscillate up and down through an arc of about 10° to 160° at the rate of about 1 to 3 cycles per second, while plate 54 may complete a horizontal sweep of about 10° to 150° in chordal steps of about 0.001 to 0.100 inch in about 15 seconds to 2 minutes.

The mounting post 60 for grinding wheel assembly 70 is slidingly supported on the upper plate 54 of bed 46 by guide assembly 64. The position of the upstanding portion of mounting post 60 relative to upper plate 54 and guide assembly 64 is controlled by threaded rod 66 and knurled knob 68. A change in the position of mounting post 60 is suggested by the phantom lines in FIG. 6.

Thus the position of mounting post 60 depends upon several controls. It is determined by the horizontal positioning of lower plate 48 relative to base 10, by the oscillatory positioning of upper plate 54 about the vertical support and by the horizontal positioning of mounting post 60 relative to guide assembly 64.

The grinding wheel assembly 70, which is assembled as a unit for rapid conversion of the shaping machine, comprises frame 80, which is removably secured to post 60 by simple conventional means (not shown), such as by bolts or similar clamping devices, and on which electric motor 82 is mounted by bolts 83. The bolt slots in frame 80 permit the vertical adjustment of the grinding wheel assembly whereby the horizontal mid-plane of the grinding wheel may be aligned with the horizontal axis 13 of arm 12, if desired. Mounting brackets 84 and 86 on electric motor 82 provide the support for the grinding wheel assembly 88 and vacuum means (hereinafter described), as can best be seen in FIG. 3. Manifestly, the grinding wheel assembly can be supported directly on frame 80 by suitable redesign, as those skilled in the art will recognize.

The grinding wheel assembly comprises brackets 89 and 90, bearing frame 91, shaft 92, aluminum oxide or any other conventional grinding wheel 93 at one extremity and pulley means 94 at the other extremity. Driving rotational forces are transmitted from motor 82 to the pulley means 94 and thus to the grinding wheel by belt 96 extending from the output shaft 98 of electric motor 82. As those skilled in the art will recognize, there are various mechanical equivalents for such power train, including directly driving the wheel by the output shaft of a motor and using various gear or chain drives or the like.

Figure 5:
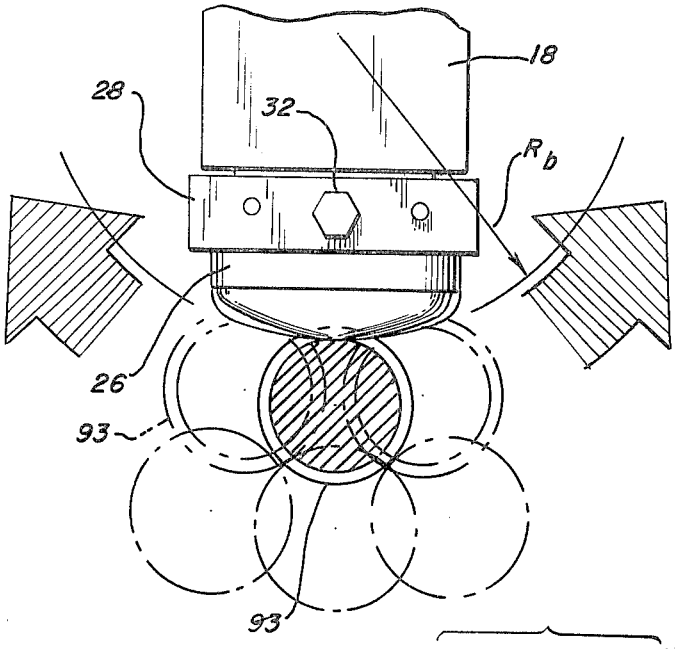
FIG. 5 is a fragmentary plan view on an enlarged scale of the holder and fixed-super-abrasive workpiece, showing by solid and phantom lines and large arrowheads the relative movement of the grinding wheel in the horizontal plane, the radius of curvature corresponding to the base curve being indicated by the single arrowhead and arc symbol.

The action of the grinding wheel is dressing the toric surface of the workpiece (tool) is depicted in FIGS. 3, 4 and 5. FIG. 3 shows the workpiece being oscillated in a vertical direction, the radius of curvature Rc at the working surface corresponding to the cross curve, as aforementioned. Simultaneously, the grinding wheel is oscillated horizontally in small stepwise increments, first in one direction and then in the other, as depicted in FIG. 5, the radius of curvature Rb corresponding to the desired base curve. The combined grinding action at two radii Rb and Rc corresponding to the desired toric configuration results in the desired dressing action.

When setting up the novel machine of the present invention, the fixed-super-abrasive workpiece is located such that the lowest area on the workpiece surface relative to the planned finished surface is at the desired finished radii. Thus, most of the dressing action will occur at the higher areas, as those skilled in the art will recognize.

As previously indicated, the fast rate of wear of the grinding wheel, as compared with that of the fixed-super-abrasive workpiece, obviates any need to perform the shape of the grinding wheel, although preformed grinding wheels may advantageously be employed in the practice of the present invention. This is illustrated in FIG. 4 wherein, at the right, the grinding wheel 93' is shown to have a right cylindrical configuration prior to contacting the workpiece 26. After contacting the workpiece, the surface rapidly assumes the curvature of the workpiece as the dressing operation proceeds, as depicted at the left in FIG. 4.

To insure that the dressing action proceeds at the desired rate despite the rapid wear of the grinding wheel, the grinding wheel 93 is periodically repositioned by adjusting the position of mounting post 60. This may readily be accomplished by periodic or continuous adjustment of knob 68. The frequency and extent of adjustment is best determined empirically depending upon a number of variables, including for example, the nature of the super-abrasive being dressed and the bond in which it is fixed, the area of the working surface being dressed, the nature of the conventional abrasive in the grinding wheel, the speeds of the various motions, including the rotational rate of the grinding wheel, the diameter and length of the grinding wheel, etc. A skilled operator should be able to achieve efficient production with practically no specific experience.

Alternative techniques may also be employed to fully automate the operation, as those skilled in the art will recognize. For example, the position of the grinding wheel may be automatically adjusted a given amount after each pass or the adjustment may be made responsive to pertinent variables as detected by available sensors, e.g., the amount of wear of the grinding wheel, the pressure exerted by the grinding wheel against the workpiece, etc. These and other additions to the machine herein described will be obvious to those skilled in the art in the light of the disclosure.

Because of the rapid rate of wear of the grinding wheel, suction or vacuum means 100 is mounted on motor 82 by means of brackets 101 and 102, the inlet being adjacent grinding wheel 93 and, preferably, including collector shield or baffle 103 to enhance residue pickup and protect the operator, as best depicted in FIG. 3. The residue is sucked into a conventional vacuum collector (not shown) by means of flexible hose 104 (FIG. 2), which is slipped on the end of suction means 100.

As is apparent from the above description, the machine of the present invention can be constructed by converting conventional shapers by simply bolting a workpiece holder at the location previously occupied by the cutting tool and bolting a grinding wheel assembly, as above described, to the post previously occupied by a workpiece holder. This minimizes the investment for multi-function operations and is particularly advantageous to the smaller manufacturer. Alternatively, the machine of the present invention may be specifically constructed for the operation contemplated herein.

From the above description it is apparent that the objects of the present invention have been achieved. While only certain embodiments have been set forth, alternative embodiments and various modifications will be apparent from the above description to those skilled in the art. These other alternatives are considered equivalents and within the spirit and scope of the present invention.

Having described the invention, what is claimed is:

1. A machine for dressing fixed-super-abrasive tools comprising in combination:

a. a base with upstanding frame;

b. a driven arm pivotally supported on said frame for at least limited vertical arc-like oscillatory movement about a horizontal axis;

c. a workpiece holder assembly suitable for holding the fixed-super-abrasive tool to be dressed and releasably securable to said arm at any predetermined position relative to said horizontal axis whereby the workpiece in said workpiece holder assembly is vertically oscillated about a horizontal axis at a first predetermined radius;

d. a grinder support bed on said base horizontally movable with respect thereto, said grinder support bed also being controllably oscillatable about a vertical axis through at least a limited horizontal arc;

e. a cylindrical grinding wheel rotatable about a vertical axis and upstandingly supported on said grinder support bed, the abrasive content of said grinding wheel consisting essentially of conventional abrasives having a hardness on the Knoop scale of less than about 3000 kg/mm$^2$, said grinding wheel being disposed to traverse adjacent said workpiece holder assembly in a horizontal arc-like movement and to bring its outer surface in line contact with the surface of the fixed-super-abrasive workpiece as said grinder support bed controllably oscillates at a second predetermined radius, whereby the fixed-super-abrasive surface of the workpiece is dressed by the relatively fast wearing conventional abrasives of said outer surface of said rotatable grinding wheel; and f. means for rotating said grinding wheel.

2. The machine of claim 1 including suction means secured adjacent said grinding wheel and disposed to remove the residue from the grinding operation as it is produced.

3. The machine of claim 1 wherein said grinding wheel is mounted on a vertically-disposed rotatable shaft having pulley means and said means for rotating said grinding wheel comprises an electric motor mounted upstandingly on said grinder support bed and operatively connected to said pulley means by belt means.

4. The machine of claim 1 wherein said workpiece holder assembly and said grinding wheel and said means for rotating said grinding wheel are releasably mounted and removable from said machine.

5. A machine for dressing fixed-super-abrasive tools comprising in combination:

a. a base with upstanding frame;

b. a driven arm pivotally supported on said frame for at least limited vertical arc-like oscillatory movement about a horizontal axis;

c. a workpiece holder assembly suitable for holding the fixed-super-abrasive tool to be dressed and releasably securable to said arm at any predetermined position relative to said horizontal axis whereby the workpiece in said workpiece holder assembly is vertically oscillated about a horizontal axis at a first predetermined radius;

d. a grinder support bed on said base including an upstanding mounting post, said support bed being horizontally movable with respect to said base and also controllably oscillatable about a vertical axis through at least a limited horizontal arc;

e. a grinder assembly secured to and supported on said upstanding mounting post and disposed to traverse adjacent said workpiece holder assembly in a horizontal arc-like movement as said grinder support bed controllably oscillates at a second predetermined radius, said grinder assembly comprising:

1. a support frame,
2. motor means supported by said support frame,
3. a cylindrical grinding wheel rotatable about a vertical axis and supported by said support frame, the abrasive content of said grinding wheel consisting essentially of conventional abrasives having a hardness on the Knoop scale of less than about 3000 kg/mm$^2$, said grinding wheel being operatively connected to and rotated by said motor means and disposed to bring its outer surface in line contact with the surface of the fixed-super-abrasive workpiece, whereby the workpiece is dressed by the relatively fast wearing conventional abrasives of said outer surface of said grinding wheel as it rotates, and
4. suction means supported by said support frame and disposed to remove the residue from the grinding operation as it is produced.

6. The machine of claim 5 wherein said workpiece holder assembly and said grinder assembly are releasably mounted and removable from said machine.

* * * * *